US008899398B2

(12) United States Patent
Wind

(10) Patent No.: US 8,899,398 B2
(45) Date of Patent: Dec. 2, 2014

(54) APPARATUS AND METHOD FOR WATER BOTTLE RETURN

(75) Inventor: Patrick E. Wind, Darien, CT (US)

(73) Assignee: Zephyr Fluid Solutions, LLC, Danbury, CT (US)

( * ) Notice: Subject to any disclaimer, the term of this patent is extended or adjusted under 35 U.S.C. 154(b) by 483 days.

(21) Appl. No.: 13/178,610

(22) Filed: Jul. 8, 2011

(65) Prior Publication Data

US 2012/0068584 A1 Mar. 22, 2012

Related U.S. Application Data

(60) Provisional application No. 61/384,002, filed on Sep. 17, 2010.

(51) Int. Cl.

| | |
|---|---|
| ***G07F 7/00*** | (2006.01) |
| ***G07F 7/06*** | (2006.01) |
| ***A47F 10/02*** | (2006.01) |

(52) U.S. Cl.

CPC ..... *A47F 10/02* (2013.01); *G07F 7/0609* (2013.01)

USPC ..... 194/205; 194/211; 220/485; 220/494; 220/495

(58) Field of Classification Search

CPC ..... G01N 21/293; G01N 21/29; G01N 21/64; G01N 21/68; G01N 2015/1037; G01N 15/1459; G01N 21/65; A61B 5/14532; A61B 2562/0295; A61B 2562/085; H01J 37/32; H01J 37/935; G01J 3/02; G01J 3/513; G07F 7/069; G07F 7/0609; G07F 7/0636; G07F 11/62; G07F 7/0627; G07F 7/04; G07F 7/02; B65H 2701/1912; G07D 11/0081; G07D 11/0084; G07D 7/00; G07D 7/12; G07D 7/20; A47F 10/02

USPC ..... 193/13, 31 A; 194/205–213, 334, 335, 194/338; 209/522, 533, 635, 655, 698, 919, 209/924, 933; 241/99, 100; 356/42, 72, 73; 220/485–495

See application file for complete search history.

(56) References Cited

U.S. PATENT DOCUMENTS

| | | | |
|---|---|---|---|
| 969,879 | A | 9/1910 | Karlson |
| 1,995,779 | A | 3/1935 | Pencovic |
| 2,931,535 | A | 4/1960 | Lockwood |
| 2,954,111 | A | 9/1960 | Gerrard |
| 3,009,674 | A | 11/1961 | Ingvartsen |
| D223,956 | S | 6/1972 | Kenerson |

(Continued)

FOREIGN PATENT DOCUMENTS

| | | |
|---|---|---|
| DE | 29706654 | 9/1997 |
| DE | 10240768 | 3/2004 |
| FR | 2641887 | 7/1990 |

*Primary Examiner* — Jeffrey Shapiro

(74) *Attorney, Agent, or Firm* — Cantor Colburn LLP

(57) ABSTRACT

An apparatus and method for receiving a recyclable product is disclosed herein. In one embodiment the apparatus includes: a structure defining an interior cavity, the structure having a plurality of walls; a bottle return mechanism for determining when a bottle has been received within the interior cavity, comprising: an elongated cylinder providing a passage into the interior cavity, the elongated cylinder having an inlet opening proximate to an exterior of the enclosed structure and an outlet opening proximate to the interior cavity; a bottle return mechanism configured to provide an output when a bottle has been inserted into the elongated cylinder; and a dispensing rack secured to one of the walls of the enclosure.

12 Claims, 6 Drawing Sheets

(56) References Cited

U.S. PATENT DOCUMENTS

| | | | |
|---|---|---|---|
| 4,207,973 | A | 6/1980 | Stampleman |
| 4,532,859 | A | 8/1985 | Solordal |
| 4,573,641 | A | 3/1986 | DeWoolfson et al. |
| 4,579,216 | A | 4/1986 | DeWoolfson et al. |
| 4,784,251 | A | 11/1988 | DeWoolfson et al. |
| D307,343 | S | 4/1990 | Lauraine, Jr. et al. |
| 4,947,988 | A | 8/1990 | Schutz |
| 4,967,045 | A | 10/1990 | Keefer |
| D314,655 | S | 2/1991 | Hosmer |
| 5,028,099 | A | 7/1991 | Bertucco |
| 5,042,634 | A | 8/1991 | Gulmini |
| D324,593 | S | 3/1992 | Kouwenhoven |
| 5,121,778 | A | 6/1992 | Baker et al. |
| 5,161,661 | A | 11/1992 | Hammond |
| 5,222,531 | A | 6/1993 | Baker et al. |
| 5,295,519 | A | 3/1994 | Baker et al. |
| D349,997 | S | 8/1994 | Ullmann |
| D351,697 | S | 10/1994 | Blotnick |
| 5,355,987 | A | 10/1994 | DeWoolfson et al. |
| 5,361,913 | A | 11/1994 | Melchionna |
| D355,289 | S | 2/1995 | Schafer |
| D361,039 | S | 8/1995 | Rokus |
| 5,465,822 | A | 11/1995 | DeWoolfson et al. |
| D377,553 | S | 1/1997 | Cozart |
| 5,630,493 | A | 5/1997 | DeWoolfson et al. |
| 5,695,039 | A | 12/1997 | Driscoll et al. |
| D388,922 | S | 1/1998 | Peters |
| 5,737,903 | A | 4/1998 | Minutillo |
| D402,037 | S | 12/1998 | Hofstad |
| D420,479 | S | 2/2000 | Delmerico |
| 6,047,843 | A | 4/2000 | Mecke |
| D428,229 | S | 7/2000 | Olivetti |
| D434,449 | S | 11/2000 | Tandberg |
| D441,023 | S | 4/2001 | Vaajakallio |
| 6,223,927 | B1 | 5/2001 | Rand |
| 6,299,061 | B1 | 10/2001 | Henson |
| 6,349,972 | B1 | 2/2002 | Geiger et al. |
| 6,547,055 | B2 | 4/2003 | Coyne et al. |
| 6,578,763 | B1 | 6/2003 | Brown |
| 6,817,462 | B1 | 11/2004 | Salda |
| D541,870 | S | 5/2007 | Tandberg |
| D542,495 | S | 5/2007 | Boydston et al. |
| D549,418 | S | 8/2007 | Boydston et al. |
| 7,296,745 | B2 | 11/2007 | Weisz et al. |
| D565,268 | S | 3/2008 | Boydston et al. |
| D566,920 | S | 4/2008 | Boydston et al. |
| 7,921,979 | B2 | 4/2011 | Kreitz et al. |
| 8,109,378 | B2 | 2/2012 | Boydston et al. |
| 2003/0042110 | A1 | 3/2003 | Wilfong |
| 2005/0073417 | A1 | 4/2005 | Mathewson, II et al. |
| 2006/0065717 | A1 | 3/2006 | Hurwitz et al. |
| 2006/0069642 | A1 | 3/2006 | Doran et al. |
| 2006/0071063 | A1 | 4/2006 | Duckett |
| 2007/0012541 | A1 | 1/2007 | Boydston et al. |
| 2007/0090938 | A1 | 4/2007 | Donaldson |
| 2007/0159308 | A1 | 7/2007 | Johnston |
| 2008/0106089 | A1 | 5/2008 | Geiger et al. |
| 2008/0121492 | A1 | 5/2008 | Kreitz et al. |
| 2008/0308383 | A1 | 12/2008 | Boydston et al. |
| 2009/0166149 | A1* | 7/2009 | Horniak ..... 193/31 R |
| 2011/0114440 | A1 | 5/2011 | Horniak et al. |
| 2012/0173016 | A1* | 7/2012 | Piersant et al. ..... 700/225 |

* cited by examiner

APPARATUS AND METHOD FOR WATER BOTTLE RETURN

CROSS REFERENCE TO RELATED APPLICATIONS

This application claims the benefit of U.S. Provisional Patent Application Ser. No. 61/384,002 filed Sep. 17, 2010, the contents of which are incorporated herein by reference thereto.

BACKGROUND

This application relates to methods for vending retail products to consumers, and more specifically to a method for vending and returning recyclable water bottles.

Recently consumers have been purchasing large sized (e.g., 5 gallon, 3 gallon or equivalently sized) water bottles for use in home or other applications in addition to those traditionally used in commercial environments wherein a delivery truck arrives periodically to collect the empty bottles while supplying a fresh supply of filled water bottles. In these applications and since it is not economically feasible for scheduled deliveries from a delivery truck, the consumer is typically purchasing one or two bottles at a time from a store while at the same time returning their empty bottles.

Accordingly, it is desirable to provide a system and a method for returning empty water bottles in a quick and efficient manner.

SUMMARY

Exemplary embodiments of the present invention relate to an apparatus and method for receiving a recyclable product. In one embodiment the apparatus includes: a structure defining an interior cavity, the structure having a plurality of walls; a bottle return mechanism for determining when a bottle has been received within the interior cavity, comprising: an elongated cylinder providing a passage into the interior cavity, the elongated cylinder having an inlet opening proximate to an exterior of the enclosed structure and an outlet opening proximate to the interior cavity; a bottle return mechanism configured to provide an output when a bottle has been inserted into the elongated cylinder; and a dispensing rack secured to one of the walls of the enclosure.

In still another exemplary embodiment, a method for recycling a water bottle is provided, the method including the steps of: inserting the water bottle into a bottle return mechanism of a structure, the bottle return mechanism being configured to determine when a bottle has been received within an internal cavity of the structure by passing though an elongated cylinder that provides a passage into the internal cavity; providing a receipt when the water bottle has been inserted into the internal cavity; and providing a plurality of filled water bottles located on a dispensing rack secured to at least one wall of the structure.

DETAILED DESCRIPTION OF EXEMPLARY EMBODIMENTS

Figure 1A:
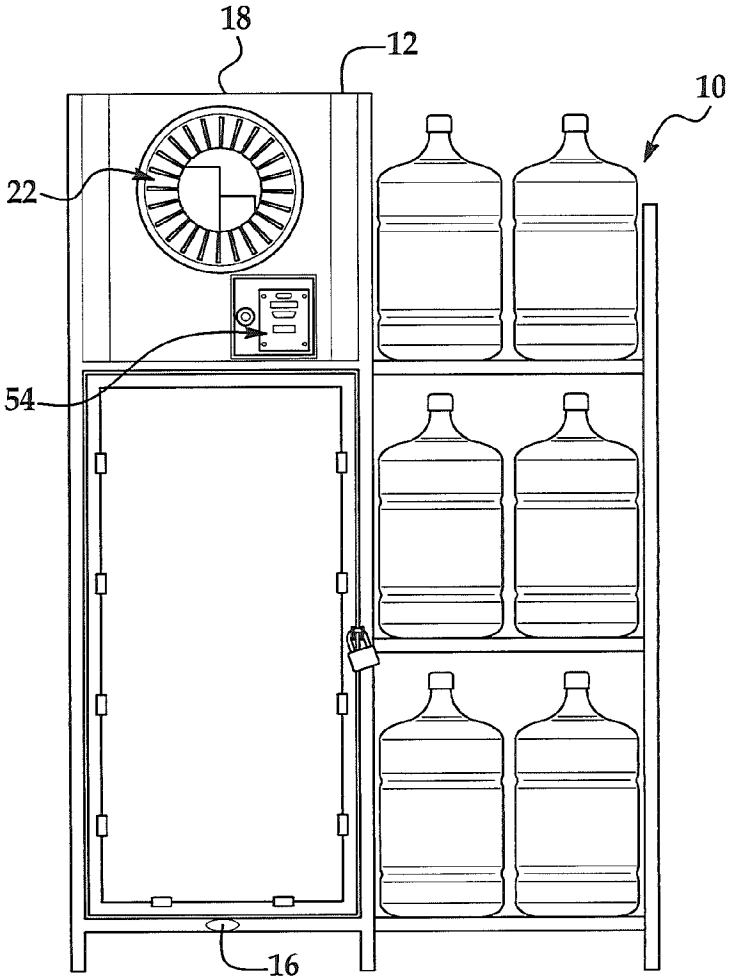
FIG. 1 is a perspective view of an exemplary bottle return apparatus in accordance with an exemplary embodiment of the present invention.

Exemplary embodiments of the present invention relate to a method and apparatus for drinking water bottles in particular, large scale models such as 5 gallon or 3 gallon varieties. Of course, other bottle sizes greater or smaller than the 5 gallon or 3 gallon size are considered to be within the scope of exemplary embodiments of the present invention.

Referring now to the FIGS. a bottle return apparatus 10 is illustrated. Bottle return apparatus 10 has a bin or enclosure 12 that is capable of holding a plurality of empty drinking water bottles for example, the aforementioned 5 gallon or 3 gallon variety. Of course, the configuration and/or size of the enclosure may vary based upon the type of empty bottles being returned, the frequency thereof and the storage capacity of the location of the bottle return apparatus.

As illustrated, the enclosure will have a plurality of walls 14, a bottom 16 and, if necessary, a top portion 18. The enclosure including the top, bottom and walls may be configured out of any suitable material capable of withstanding repeated use and, if applicable, the elements. In one non-limiting exemplary embodiment the enclosure will resemble a cage like structure wherein the bars of the enclosure are sufficiently spaced such that any of the returned bottles will not pass therethrough.

In order to empty the enclosure after it has been filled with a plurality of empty bottles, a door is located on one of the walls or alternatively one of the walls is that we secured to the other one of the walls such that it may act as a door. Once the door is opened the empty bottles may be retrieved from an interior cavity of the enclosure.

Figure 1:
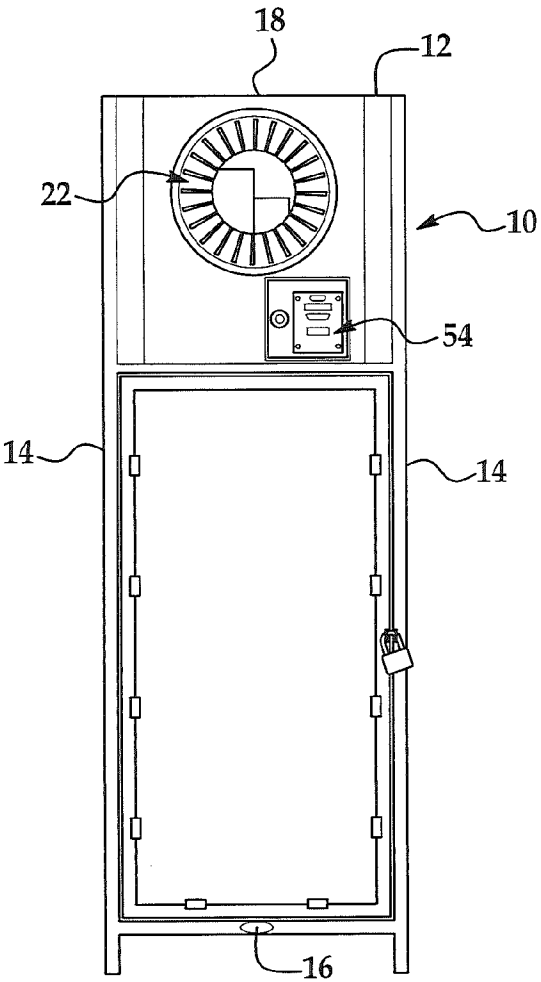
Figure 2:
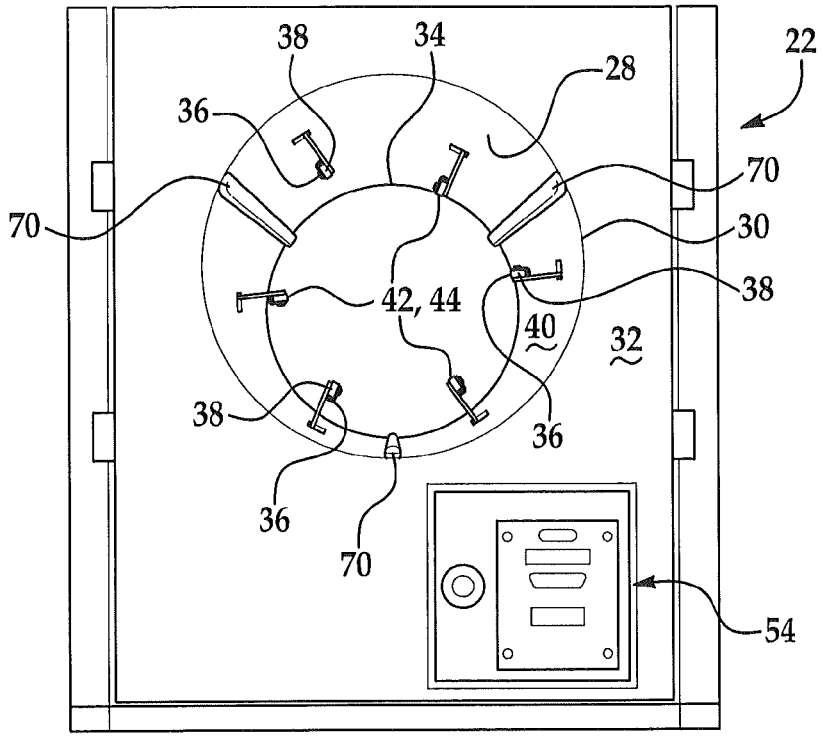
FIGS. 2-7 illustrate a bottle return mechanism of an exemplary embodiment of the present invention for use with the bottle return apparatus illustrated in FIG. 1.
Figure 3:
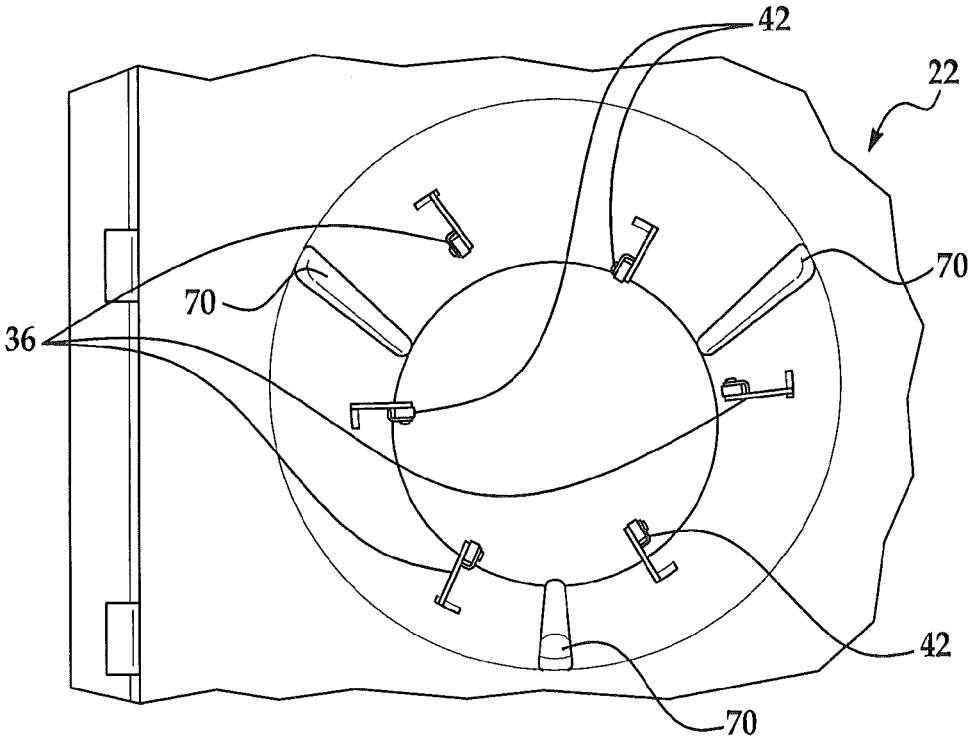

As illustrated in FIGS. 1 and 1A, the apparatus may be an enclosure (FIG. 1) or a combo enclosure and dispensing rack for new filled water bottles (FIG. 1A). As illustrated in FIG. 1A, the combo enclosure includes a dispensing rack 19 secured to one of the walls 14 of the enclosure 12. In one non-limiting exemplary embodiment, the dispensing rack 19 has a plurality of shelves 21 each being spaced to receive and support a plurality of water bottles 50. As mentioned above, the water bottles 50 include but are not limited to 5 gallon or 3 gallon water bottles. Of course, other bottle sizes greater or smaller than the 5 gallon or 3 gallon size are considered to be within the scope of exemplary embodiments of the present invention.

As illustrated in FIG. 1A and in one non-limiting embodiment, the width of the shelves 21 is substantially similar to the width of the enclosure 12. In addition, each of the shelves 21 can be configured to have a guide rail 23 such that at least two water bottles 50 or at least two rows of water bottles 50 (depending on the depth of the shelf 21) can be placed on each shelf 21 in a vertical orientation. Of course, other orientations and configurations are contemplated to be within the scope of exemplary embodiments of the present invention.

In one non-limiting exemplary embodiment, each shelf 21 is configured to receive two rows of 5 gallon water bottles and each row has three water bottles. Moreover and in one non-limiting exemplary embodiment, the dispensing rack has three shelves 21.

Figure 10:
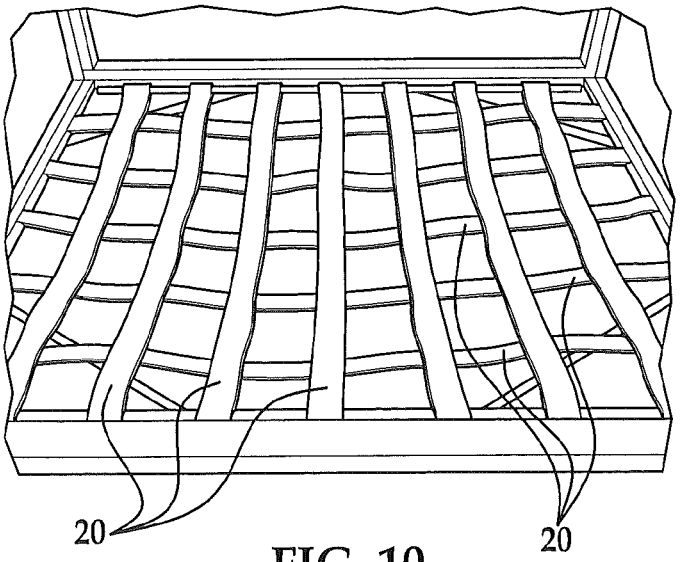
FIG. 10 is a view of a portion of a bottle return apparatus in accordance with an embodiment of the present invention.

In one embodiment, the bottom portion of the enclosure is constructed out of material that will prevent damage to the bottles as they are inserted into the enclosure. For example and in one non-limiting embodiment, the bottom portion is formed from a plurality of canvas or nylon straps 20 arranged in an interlocking fashion (FIG. 10).

As illustrated, the bottle return apparatus includes a bottle return mechanism 22 for determining when a bottle 24 has been received within an interior cavity 26 of the enclosure. In one non-limiting embodiment, the bottle return mechanism has an elongated cylinder 28 that provides a passage into the interior cavity of the enclosure. The elongated cylinder has an inlet opening 30 proximate to an exterior 32 of the enclosure and an outlet opening 34 proximate to the interior cavity.

In order to detect when a bottle has been inserted into the enclosure through the bottle return apparatus a first plurality of actuating arms 36 are located within the passage. The first plurality of actuating arms are pivotally secured to the elongated cylinder for movement between a first position (see at least FIGS. 2, 3, 4 and 6) wherein a distal end 38 of each of the plurality of actuating arms is positioned away from a surface 40 of the elongated cylinder and a second position (see at least FIGS. 5 and 7) wherein the distal end of each of the plurality of actuating arms is moved towards the surface of the elongated cylinder.

In addition, a second plurality of actuating arms 42 are also located in the passage however, the second plurality of actuating arms are positioned further away from the inlet opening than the first plurality of actuating arms.

Similar to the first plurality of actuating arms, the second plurality of actuating arms are also pivotally secured to the elongated cylinder for movement between a first position (see at least FIGS. 2, 3, 4 and 6) wherein a distal end 44 of each of the plurality of actuating arms is positioned away from the surface of the elongated cylinder and a second position (see at least FIGS. 5 and 7) wherein the distal end of each of the plurality of actuating arms is moved towards the surface of the elongated cylinder.

In one non-limiting exemplary embodiment, each of the plurality of actuating arms (first and second) and the elongated cylinder are configured such that as a predetermined sized water bottle is inserted into the elongated opening in a first direction (e.g., from the inlet opening towards the interior cavity) the distal ends of the actuating arms will contact the water bottle and be moved towards the second position.

Figure 4:
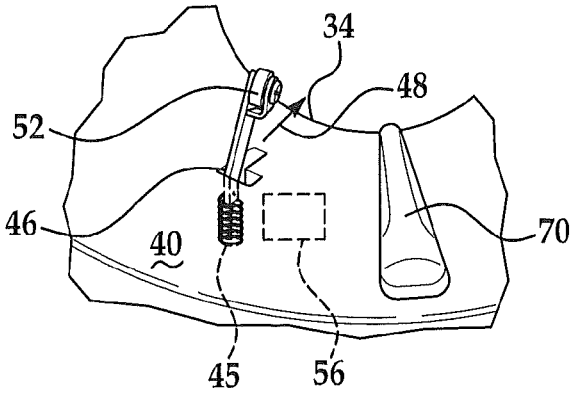
Figure 5:
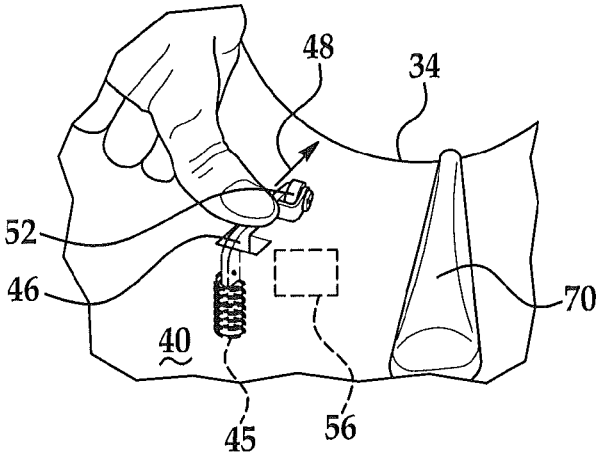

Each of the plurality of actuating arms will be spring biased into the first position by a spring 45 or other equivalent device such that as the predetermined sized water bottle passes therethrough the actuating arms will return back to the first position. Moreover, and to prevent a bottle from being removed from the bottle return mechanism after it has been inserted therein at least one of or all of the first plurality of actuating arms are configured such that they cannot be moved from the first position towards the inlet opening. In other words, the first plurality of actuating arms are configured for movement in a first direction namely from the first position towards outlet opening as well as the surface of the elongated cylinder thereafter the plurality of actuating arms are spring biased back into the first position however, movement from the first position towards the inlet opening is prevented. Similarly, and if necessary, the second plurality of actuating arms are also configured for the same type of movement namely from the first position towards the outlet opening and the surface of the elongated cylinder and thereafter back to the first position however, movement from the first position towards the inlet opening which would allow a water bottle to be extracted from the bottle return mechanism is prevented. The movement of the actuating arms from the first position towards the outlet opening and the prevention of the movement of the actuating arms from the first position towards the inlet opening is achieved through a slot or opening 46 in the surface of the elongated cylinder. For example, FIG. 4 illustrates one of the first plurality of actuating arms in the first position and FIG. 5 illustrates movement of this actuating arm in the direction of the arrow 48 towards the outlet opening 34 or the second position.

Figure 6:
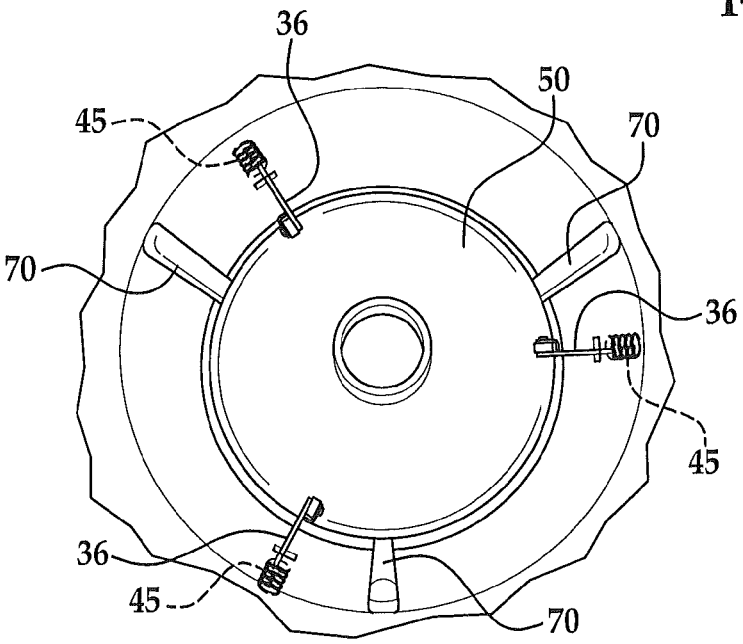
Figure 7:
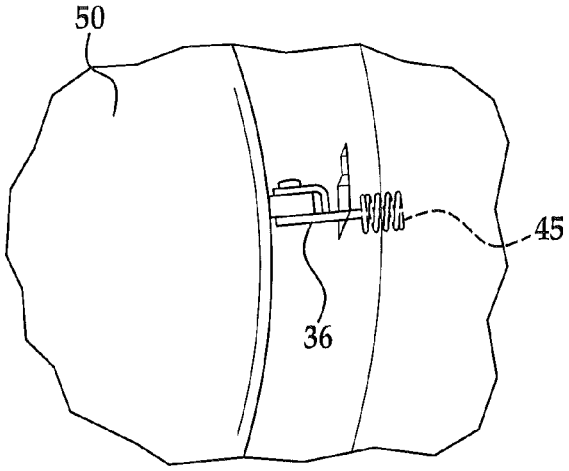

FIG. 6 illustrates an empty water bottle 50 inserted into the bottle return mechanism wherein the empty water bottle has been inserted past the first plurality of actuating arms 36 each of which has now sprung back to the first position. Accordingly and when these actuating arms are in the first position the removal of the empty water bottle 50 from the elongated cylinder is prevented. FIG. 7 illustrates an exterior surface of the empty water bottle contacting a distal end of one of the plurality of actuating arms after it has been moved towards the surface of the elongated cylinder.

In one non-limiting exemplary embodiment and in order to facilitate movement of the empty water bottle into the bottle return mechanism each of the distal ends of the plurality of actuating arms has a ball bearing 52 rotatably secured thereto. In addition and in one non-limiting embodiment, the first plurality of actuating arms are located a first distance from the inlet opening while the second plurality of actuating arms are located a second distance from the inlet opening, wherein the second distance is greater than the first distance.

Moreover and in order to give a user a receipt when they have deposited an empty bottle into the bottle return mechanism another mechanism 54 is coupled to or comprises a portion of the bottle return mechanism. This mechanism is configured to provide an output (e.g., a coupon or receipt) when the first plurality of actuating arms and the second plurality of actuating arms have been simultaneously moved to the second position and thereafter back to the first position thus indicating that an empty bottle has been properly received within the bottle return apparatus.

In order to provide this output at least one or all or any combination of the first plurality of actuating arms are coupled to or proximate to a sensor 56 that provides a signal indicative of the position of the actuating arm. Accordingly and as the actuating arm is moved from the first position to the second position, the sensor will detect this movement and provide a first signal. Thereafter and as the bottle passes through the actuating arm will move back to the second position and the sensor will provide a second signal. The first signal and the second signal will be received by a microprocessor or other equivalent device coupled to the sensors of the actuating arms.

In addition, at least one or all or any combination of the second plurality of actuating arms are also coupled to or proximate to a sensor that provides a signal indicative of the position of the actuating arm. Accordingly and as the actuating arm of the second plurality of arms is moved from the first position to the second position, the sensor will detect this movement and provide a corresponding first signal. Thereafter and as the bottle passes by the actuating arms of the second plurality of actuating arms the arms will move back to the first position and a corresponding second signal will be received.

In one embodiment and in order to determine when a bottle has been properly received by the bottle return mechanism the mechanism 54 must receive corresponding signals from the associated sensors of the first plurality of actuators and the second plurality of actuators. Furthermore and in one embodiment, the mechanism must receive a corresponding first signal from at least one of the first plurality of actuators and at least one of the second plurality of actuators simultaneously. The receipt of these two signals simultaneously will indicate that the actuating arms of both the first plurality of arms and the second plurality of arms have been manipulated thereto by the empty bottle. This ensures that a properly sized bottle has been inserted into the bottle return mechanism since the first plurality of actuating arms are closer to the inlet opening than the second plurality of actuating arms or in other words, the first plurality of actuating arms are offset from the second plurality of actuating arms.

Thereafter and as the bottle is pushed all the way through the elongated cylinder the first plurality of actuating arms and the second plurality of actuating arms will spring back to the first position and a corresponding signal will also be received and supplied to the mechanism. Once the mechanism receives this second signal it now can determine that an empty bottle has been inserted into the bottle return mechanism and a coupon or receipt will be generated by the mechanism. The coupon or receipt is then used by the consumer when the purchase another filled water bottle.

In an embodiment of the present invention, the surface of the elongated cylinder also has a plurality of guide rails 70 that are configured to assist in the insertion of the water bottle into the bottle return mechanism.

Figure 8:
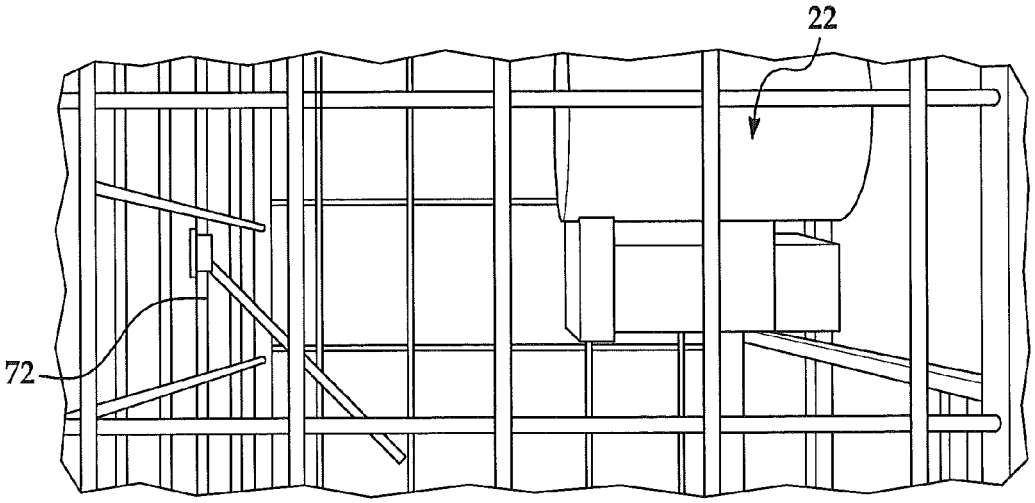
FIG. 8 is a view of a portion of a bottle return apparatus in accordance with an embodiment of the present invention.
Figure 9A:
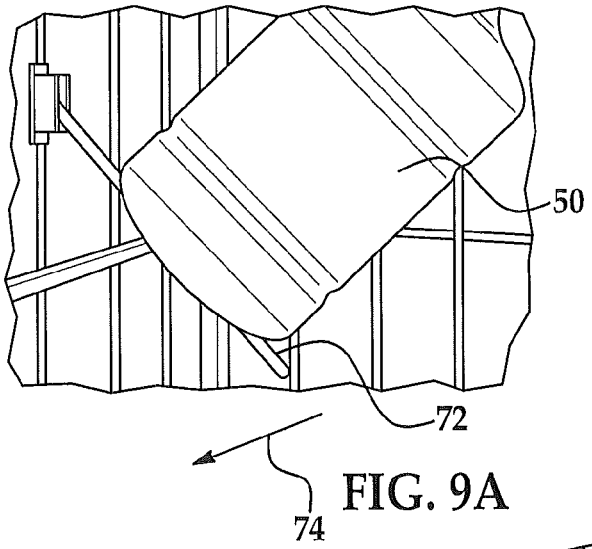
FIGS. 9A and 9B illustrate a bottle dropping into the bottle return apparatus of an exemplary embodiment of the present invention.
Figure 9B:
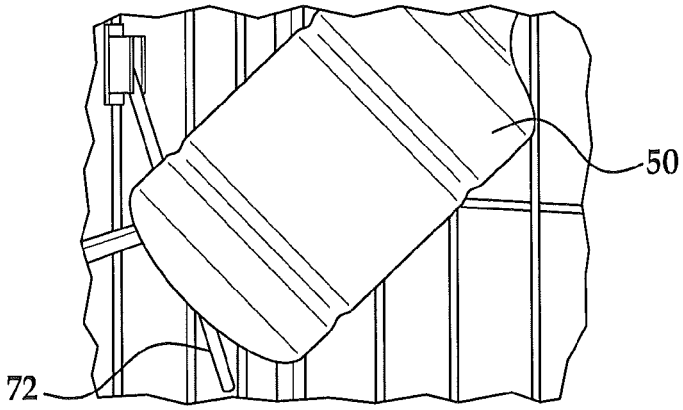

In still another alternative exemplary embodiment and in order to prevent damage to the empty water bottles as they are dropped into the receiving area of the slow the dropping of the bottle into the receiving area of the enclosure as it exits the outlet opening of the bottle return mechanism. A buffering bar 72 is pivotally secured to a wall of the enclosure. As illustrated in FIGS. 8, 9A and 9B, the buffering bar is spring biased into a first position FIG. 8 and then as the bottle exits the bottle return mechanism the bottle contacts the buffering bar (FIG. 9A) and pushes it downwardly in the direction of arrow 74 against the spring biasing force of the buffering bar in order to slow the dropping force of velocity of the bottle such that the force of the impacts of the bottle against the bottom surface of the enclosure are minimized. Accordingly, the buffering bar is located such that the bottle has to be buffered by the buffering bar before is hits the bottom of the enclosure of other bottles in the enclosure.

In addition and as discussed above, the bottom portion of the enclosure is constructed out of material that will also prevent damage to the bottles as they are inserted into the enclosure. For example and in one non-limiting embodiment, the bottom portion is formed from a plurality of canvas or nylon straps 20 arranged in an interlocking fashion (See at least FIG. 10).

Figure 11B:
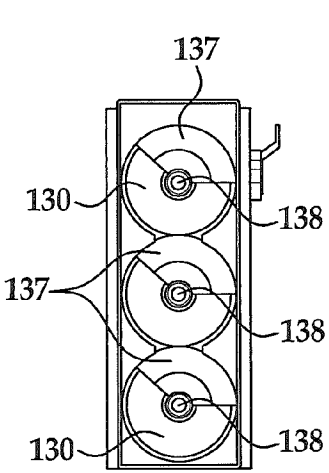
FIGS. 11-11E illustrate an alternative exemplary embodiment of the present invention.
Figure 11E:
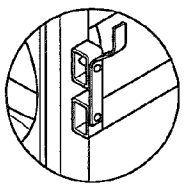
Figure 11A:
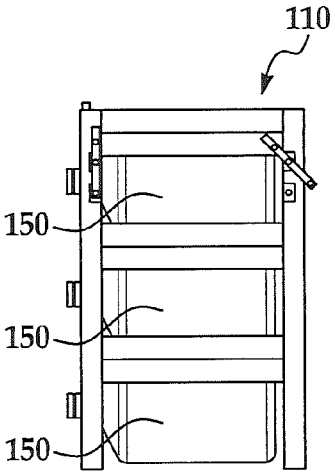
Figure 11D:
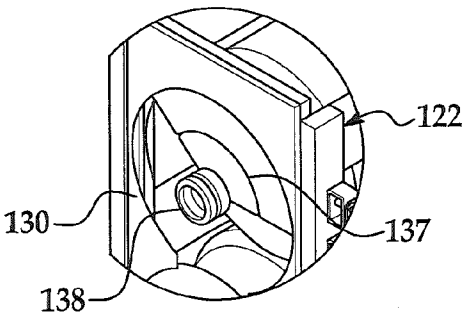
Figure 11:
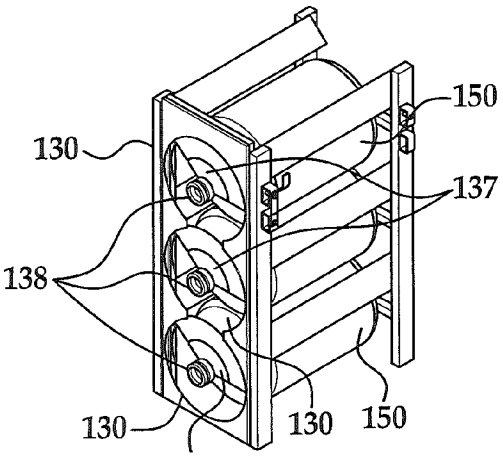
Figure 11C:
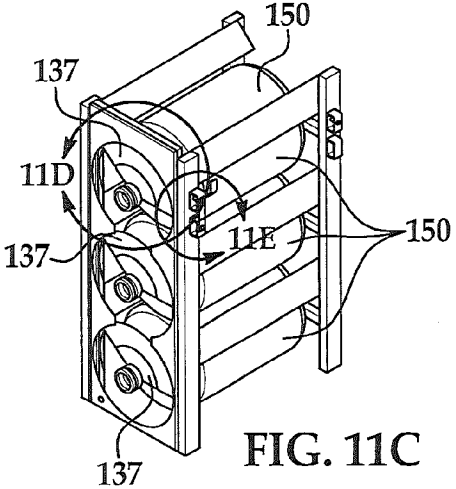

Referring now to FIGS. 11-11E an alternative exemplary embodiment is illustrated. Here an apparatus 110 for receiving recyclable product such as a water bottle 150 is illustrated. In this embodiment, the apparatus is configured such that lower access points for bottle recycling are provided. This is particularly advantageous for elderly, disabled or other consumers who cannot lift the empty water bottle to the elevated bottle return mechanism illustrated in FIGS. 1-10.

In this embodiment, an enclosed structure 112 of the apparatus defines a cavity for receipt of the bottle therein. Apparatus 110 has a bottle return mechanism 122 for determining receiving and engaging a bottle when it has been inserted into the apparatus. The apparatus provides a passage having an inlet opening 130 proximate to an exterior of the enclosed structure and an outlet opening 134 proximate to another exterior surface of the enclosure. A flexible member 137 is located proximate to the inlet opening. The flexible member is configured to be deflected inwardly towards a surface of the passage a first position wherein a distal end 138 of the flexible member is positioned in the inlet opening. The flexible member is constructed out of a resilient material such as plastic or metal, wherein the flexible member is biased towards the first position and is configured to cover a portion of the inlet opening when it is in the first position such that the distal end of the flexible member will prevent a bottle that is completely inserted into the passage through the inlet opening in a first direction from being subsequently removed from the passage in a direction opposite to the first direction.

While the invention has been described with reference to one or more exemplary embodiments, it will be understood by those skilled in the art that various changes may be made, the various steps may be accomplished in different ways, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. An apparatus for receiving a recyclable product, comprising:

a structure defining an interior cavity, the structure having a plurality of walls;

a bottle return mechanism for determining when a bottle has been received within the interior cavity, comprising: an elongated cylinder providing a passage into the interior cavity, the elongated cylinder having a circular inlet opening proximate to an exterior surface of the enclosed structure and an outlet opening proximate to the interior cavity, wherein the interior of the cavity is defined by the plurality of walls at least one of which is a side wall extending vertically with respect to the cavity and wherein the bottle return mechanism comprises: a first plurality of actuating arms located in the passage, wherein the first plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder, the first plurality of actuating arms being located a first distance from the inlet opening; and a second plurality of actuating arms located in the passage, wherein the second plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder the second plurality of actuating arms being located a second distance from the inlet opening the second distance being greater than the first distance; and a mechanism coupled to the bottle return mechanism, the mechanism being configured to provide an output when the first plurality of actuating arms and the second plurality of actuating arms have been simultaneously moved to the second position and thereafter back to the first position; and a dispensing rack secured to the side wall, wherein the dispensing rack has a plurality of shelves each extending from the side wall and each of the plurality of shelves being configured to receive and support a plurality of water bottles vertically arranged thereon in a top to bottom orientation such that the bottom of each of the plurality of water bottles is supported by one of the plurality of shelves, wherein a width of each of the plurality of shelves is substantially similar to a width of the enclosure and wherein a top one of the plurality of shelves is aligned with a bottom portion of the bottle return mechanism.

2. The apparatus as in claim 1, wherein the bottle is a 5 gallon or 3 gallon water bottle.

3. The apparatus as in claim 1, wherein the width of each of the plurality of shelves is greater than 2 water bottles vertically arranged and placed side by side and less than 3 water bottles vertically arranged and placed side by side.

4. The apparatus as in claim 1, wherein each of the plurality of shelves is configured to have a guide rail.

5. The apparatus as in claim 4, wherein the guide rail is configured such that at least two water bottles or at least two rows of water bottles can be placed side by side on each shelf.

6. The apparatus as in claim 5, wherein the guide rail and each of the plurality of shelves is configured so that each row may contain three water bottles.

7. The apparatus as in claim 1, wherein the dispensing rack has three shelves.

8. The apparatus as in claim 1, wherein the output of the mechanism is a receipt.

9. The apparatus as in claim 1, wherein the first plurality of actuating arms and the second plurality of actuating arms are configured to prevent the bottle from being removed from the elongated cylinder once either or both the first plurality of actuating arms and/or the second plurality of actuating arms have been moved from the first position to the second position and back to the first position as the bottle slides through the elongated cylinder.

10. A method for recycling a water bottle, comprising:

inserting the water bottle into a bottle return mechanism of a structure, the bottle return mechanism being configured to determine when a bottle has been received within an internal cavity of the structure by passing through an elongated cylinder that provides a passage into the internal cavity, wherein the bottle return mechanism comprises: a first plurality of actuating arms located in the passage, wherein the first plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder, the first plurality of actuating arms being located a first distance from an inlet opening of the elongated cylinder; and a second plurality of actuating arms located in the passage, wherein the second plurality of actuating arms are pivotally secured to the elongated cylinder for movement between a first position wherein a distal end of each of the plurality of actuating arms is positioned away from a surface of the elongated cylinder and a second position wherein the distal end of each of the plurality of actuating arms is moved towards the surface of the elongated cylinder, the second plurality of actuating arms being located a second distance from the inlet opening, the second distance being greater than the first distance; and a mechanism coupled to the bottle return mechanism, the mechanism being configured to provide an output when the first plurality of actuating arms and the second plurality of actuating arms have been simultaneously moved to the second position and thereafter back to the first position;

providing a receipt when the water bottle has been inserted into the internal cavity; and providing a plurality of filled water bottles located on a dispensing rack secured to at least one wall of the structure, wherein the at least one wall of the structure is a side wall extending vertically with respect to the cavity and wherein the dispensing rack has a plurality of shelves each extending from the side wall and each of the plurality of shelves are configured to receive and support the plurality of filled water bottles vertically arranged thereon in a top to bottom orientation such that the bottom of each of the plurality of filled water bottles is supported by one of the plurality of shelves, wherein a width of each of the plurality of shelves is substantially similar to a width of the structure defining the internal cavity and wherein a top one of the plurality of shelves is aligned with a bottom portion of the bottle return mechanism.

11. The method as in claim 10, wherein the plurality of filled water bottles are either a 3 gallon or 5 gallon water bottle.

12. The apparatus as in claim 10, wherein the first plurality of actuating arms and the second plurality of actuating arms are configured to prevent the bottle from being removed from the elongated cylinder once either or both the first plurality of actuating arms and/or the second plurality of actuating arms have been moved from the first position to the second position and back to the first position as the bottle slides through the elongated cylinder.

* * * * *